US006352614B1

(12) United States Patent
Linnonmaa et al.

(10) Patent No.: US 6,352,614 B1
(45) Date of Patent: Mar. 5, 2002

(54) METHOD FOR GUIDING A PAPER OR BOARD WEB

(75) Inventors: Jukka Linnonmaa, Appleton, WI (US); Jorma Kinnunen, Järvenpää (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/151,504

(22) Filed: Sep. 11, 1998

Related U.S. Application Data

(60) Provisional application No. 60/059,020, filed on Sep. 16, 1997.

(51) Int. Cl.[7] ..... D21F 1/36

(52) U.S. Cl. ..... 162/193; 162/197; 162/198; 242/615.21; 226/3

(58) Field of Search ..... 162/193, 197–198, 162/255, 270, 263, 289, 306, 307, 202; 226/12, 111, 3; 242/615.21, 615.3, 615.4, 157 R, 147 R; 34/114, 117, 444, 447, 120

(56) References Cited

U.S. PATENT DOCUMENTS

| | | | | |
|---|---|---|---|---|
| 3,570,735 A | * | 3/1971 | Kurz | 226/3 |
| 4,140,574 A | * | 2/1979 | Justus | 162/257 |
| 4,406,739 A | * | 9/1983 | Kankaanpaa | 162/203 |
| 4,551,203 A | * | 11/1985 | Eskelinen | 162/202 |
| 5,557,860 A | * | 9/1996 | Kotitschke et al. | 34/455 |

* cited by examiner

*Primary Examiner*—Jose Fortuna
(74) *Attorney, Agent, or Firm*—Cohen, Pontani, Lieberman & Pavane

(57) ABSTRACT

Method and apparatus for guiding a paper or board web in a paper manufacturing machine, a board manufacturing machine, or finishing units in connection with such machines. Web travel is guided by changing the travel position of at least one wire travelling in contact with the web such that the velocity vector of the wire at least at the point of contact of the web and the wire is directed sideways from the travel direction of the web center line when the web is brought onto the wire.

12 Claims, 2 Drawing Sheets

1
2
3
4
5
6
7
8
9

METHOD FOR GUIDING A PAPER OR BOARD WEB

This is a provisional application No. 60/059,020 filed on Sep. 16, 1997

FIELD OF THE INVENTION

The present invention concerns a method for guiding a paper or board web in a paper manufacturing machine, a board manufacturing machine, or finishing units in connection with such machines. The present invention also concerns an apparatus for using the wire guide rolls of the above-mentioned finishing units for guiding the web.

BACKGROUND OF THE INVENTION

In the following, the present invention is described in connection with a paper manufacturing machine or paper finishing units but it is equally well applicable in connection with board manufacturing machinery.

In modern high-speed paper manufacturing machines and multi-station coaters, the web being treated or prepared must travel straight in an accurately aligned manner. As the length of the machines as well as the distance covered by the web increases with the increasing speeds of the machines, an increase in speed affects web control in many ways. At high speeds, controlling the web is made more difficult by an air film formed between the web and the rolls, the film preventing even an accurately aligned set of rolls in a machine from hindering lateral transfer of the web caused by external forces. External forces affecting web travel are caused by, e.g., an imbalance between the blast driers, uneven web tension, moisture, and coat weight profiles. Constructional features affecting web travel include the perpendicularity of the rolls as well as the level of the roll ends, the symmetry of the suction effect of the airborne blast driers and the distance thereof from the web, particularly differences in the distance between the front and the driving side of the machine, the perpendicularity of the unwinder and possibly the unequal sidedness of the web. Naturally, the aim is to construct a coater such that the web travels straight, and that, should the web travel be skew due to, e.g., defective installation, the problem can be corrected by adjusting the machine.

Web transfer that is not due to constructional features of the machine is more difficult to control. With the rising speed of a wire-furnished cylinder group, for example, a phenomenon occurs where an air film is formed between the smooth cylinder surface and the paper web whereby friction vanishes and, because of the effect of centrifugal forces, the web is pressed against the drying wire which thus alone determines the travel of the web. In a high-speed machine, a rough and air-permeable drying wire together with the unwinding/reeling section and the blade sections offers one of the few chances for the web to be in proper frictional contact with a surface.

Efforts have been made to improve the contact between the web and the rolls, among other solutions, by providing the rolls with air exhaust channels, thus attaining a longer-lasting guiding effect of the rolls. However, this will not suffice when high travelling speeds are applied, because the amount of air handled by the air exhaust channels will be considerable and the web will form an air film over the roll ridges in spite of the channels. At high speeds, centrifugal forces will detach the web from the rolls unless very high web tension levels are used. This, again, is impossible due to the risk of web breaks. In future high-speed coaters these points will be accentuated because a probable line of development comprises switching over to machines with an essentially airborne web. In airborne web travel even the smallest imbalance between the blast driers causes transfer of the web, and the balance between the blast driers is more difficult to control than the perpendicularity of the rolls.

SUMMARY OF THE INVENTION

The aim of the present invention is to achieve a method and apparatus for effective active guiding of the travel of the web in the lateral direction of the machine.

According to the present invention, the travel position of at least one wire travelling in contact with the web is altered such that the velocity vector of the wire at least at the point of contact of the web and the wire is directed sideways in relation to the travel direction of the center line of the web when the web is brought onto the wire.

The present invention makes use of the phenomenon observed in coaters whereby the position of the web can be most efficiently influenced. Advantageously, the position of the web is controlled by means of the wire of the drying cylinder group by adjusting the perpendicularity of the wire stretching roll. The method can be applied to existing machines without changing the machine construction in any way. Then the adjustment of the web position is carried out manually. The adjustment can even easily be carried out automatically, whereby, e.g., the wire stretching roll is altered such that it can be adjusted by using a screw jack or a similar actuator unit. By altering the position of the wire stretching roll by means of an actuator unit the travel of the web can be actively influenced and the web can be made to stay centrally positioned in the machine even with changing travelling conditions. Adjustment of the web position during travel is most advantageously carried out in connection with web position gauging.

By means of the wire, effective web guiding is achieved even in high-speed machinery because the web is easily pressed against an air-permeable web. This makes it possible to guide the wire even in machines where the web is mostly guided in an airborne manner. There is no need to increase web tension, nor is the risk of web breaks increased. During test runs wire strength was not impaired, and the wire guiding effect on the position of the web was clear and significant.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figures 1A, 1B, 1C:
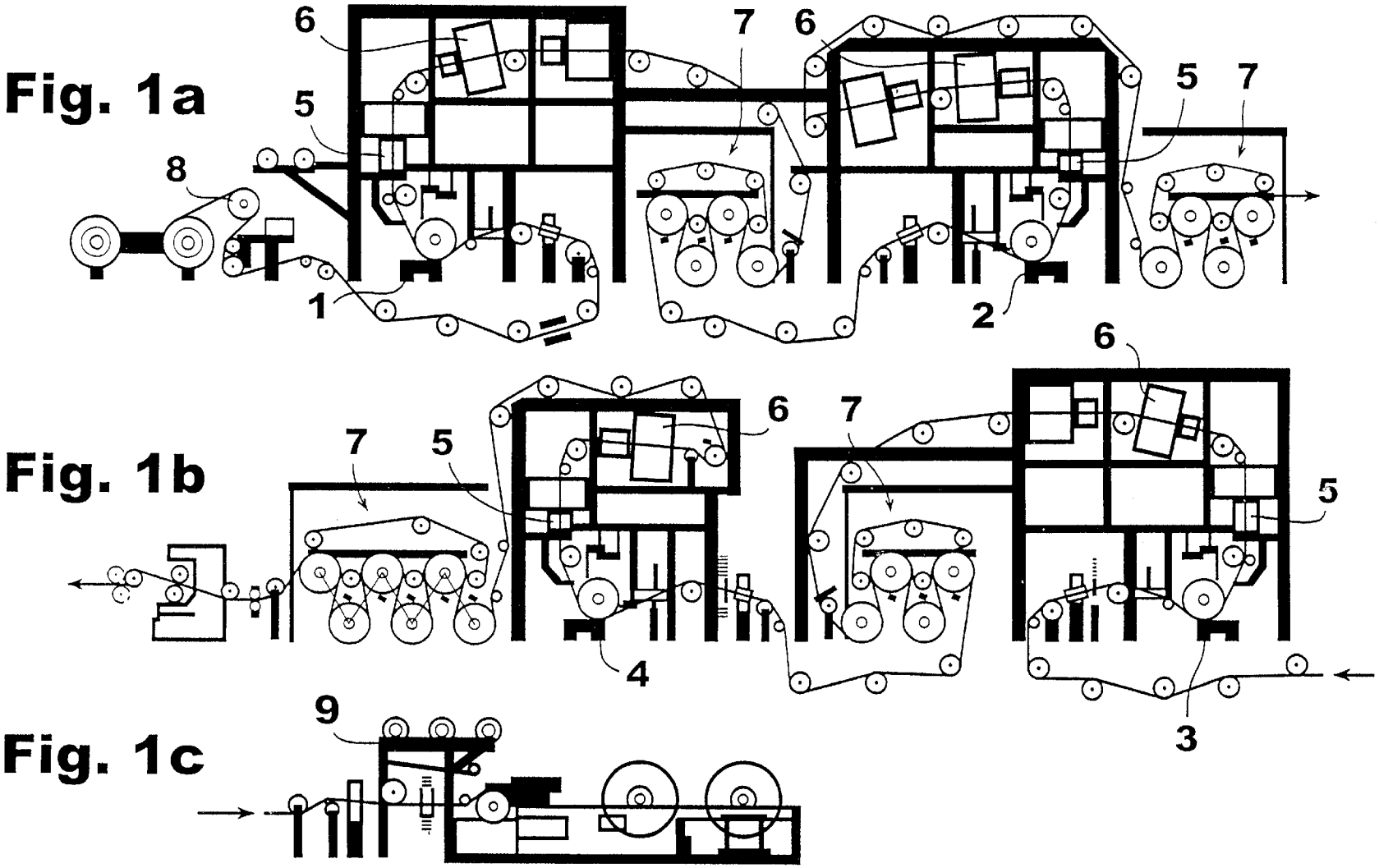
FIGS. 1*a*, 1*b* and 1*c* together depict an off-machine coater with four coating heads.

FIGS. 1*a*, 1*b* and 1*c* together depict a typical off-machine coater used for duplex coating of paper. In FIG. 1*a,* the paper web being coated travels from left to right. The web continues from the right side of FIG. 1*a* to the right side of FIG. 1*b,* in which the web travels from right to left. The web continues from the left side of FIG. 1*b* to the left side of FIG. 1*c*, in which the web travels from left to right. The present invention is in no way limited to this machine but is applicable to all units used for treating paper or board wherein the web is guided by means of a wire travelling via the rolls.

A coater intended for duplex coating comprises four coating heads 1 to 4, and each coating head is followed by a drying section comprising infrared dryers 5, airborne web-dryers 6, and groups of drying cylinders 7. The required drying performance depends, among other things, on the speed of the machine, the coat type and the coat weight. With an increased drying performance requirement the machine length is also increased, and the total length of a machine such as the one depicted in FIG. 1 may be as great as 400 m. As this is an off-machine coater, it comprises an unwinder 8 for unwinding a roll from the paper machine and, naturally, a reeler 9 for reeling up the coated paper. In such a machine, several rolls are required for guiding the web, and controlling the travel of the web is a demanding task.

Figure 2:
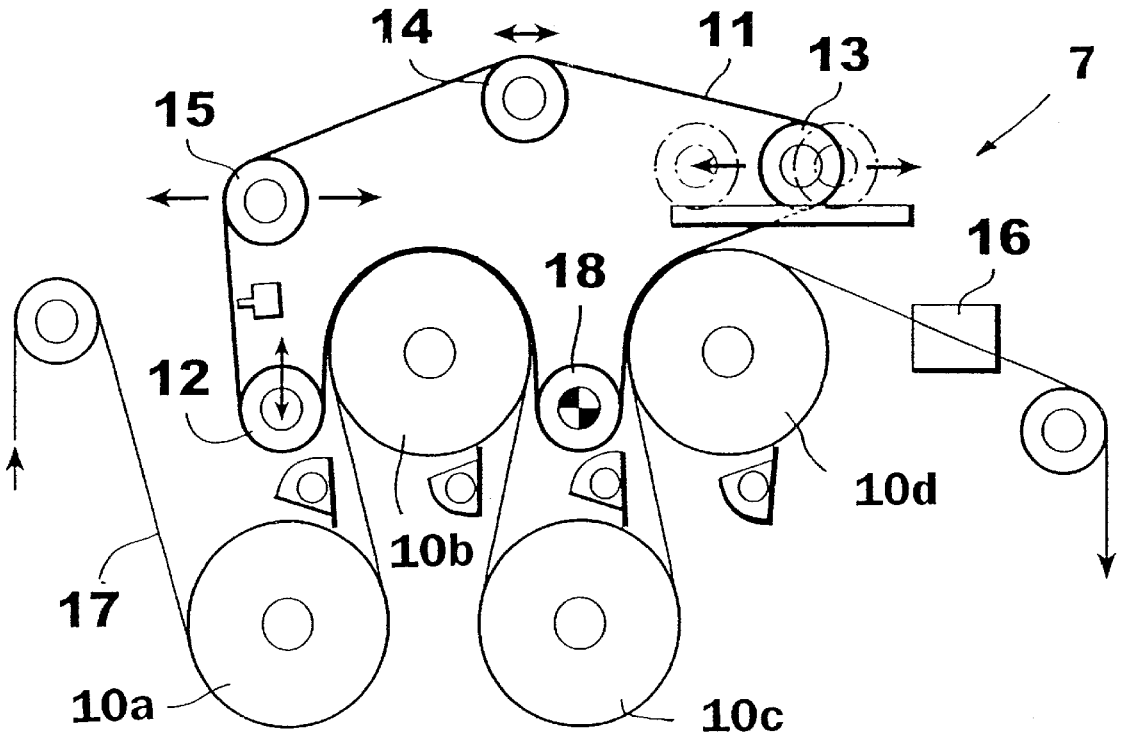
FIG. 2 depicts a group of drying cylinders.

A drying cylinder group 7 is depicted in FIG. 2. The drying cylinder group consists of a drying wire 11 and drying cylinders 10*a,* 10*b,* 10*c,* 10*d* arranged in two rows on top of one another and aligned perpendicularly to the web and the wire 11 with great accuracy, as well as of creasing rolls 12 determining the line of travel of the wire. The travel of the wire 11 is controlled by a wire guide roll 14 and its tension by a wire stretching roll 13. The exemplifying apparatus of FIG. 2 has four drying cylinders 10*a,* 10*b,* 10*c,* 10*d* and the drying wire 11 travels via the upper rolls. The wire 11 reaches the first upper drying cylinder 10*b,* that is, the second cylinder in the travel direction of the web 17, guided by the first creasing roll 12 and passes via the second creasing roll 18 and the fourth cylinder 10*d* to the wire stretching roll 13 above the drying cylinders 10*a,* 10*b,* 10*c,* 10*d,* then to the wire guide roll 14, and finally to the web guide roll 15, whereafter the wire 11 loop is completed at the first creasing roll 12. The paper web 17 is brought from the previous treatment step, in the case of FIG. 1 from the air dryers 6 to the first drying cylinder 10*a* and travels via the cylinders 10*a*, 10*b*, 10*c*, 10*d* such that at the upper drying cylinders 10*b,* 10*d* the web 17 travels supported by the wire 11.

The drying cylinder group according to the present invention comprises at least one roll 15 in addition to the wire guide roll 14, the perpendicularity of which in relation to the wire 11 is adjustable so as to make it possible to control the position of the wire in the machine. This roll 15 is called the web guide roll. As the web is detached from the drying cylinders 10 at high speeds due to the influence of the air travelling with the web 17, but the air-permeable wire 11 stays in contact with the web 17, it is the wire 11 that determines the travel of the web 17. Normally, the aim is to keep the wire 11 straight and centrally aligned in the machine. Then the wire 11 is guided by turning the wire guide roll 14 in relation to the wire 11, thus transferring the wire 11 into the direction determined by the swivelling position of the roll. Wire tension and the force directed toward the drying cylinders are controlled by means of a wire stretching roll 13 which can be adjusted in a transverse direction in relation to the wire level. Both ends of the wire stretching roll 13 are transferred parallel in order to keep the transverse tension profile even. The stretching roll 13 is also used to compensate for elongation of the wire during operation.

Figure 3:
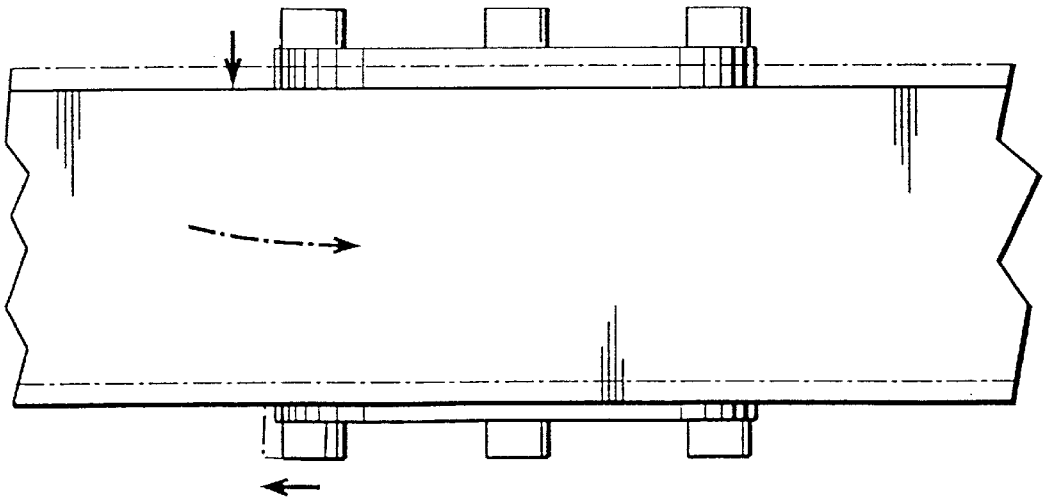
FIG. 3 is a schematic representation of the effect of wire guiding on the travel of the web.

The wire 11 can be used to control web travel by means of coaction of the web guide roll 15 and the wire guide roll 14. Hereby a web position measuring device 16 is advantageously exploited. When the web position measuring device 16 detects a deviation of the web 17 from the center line of the machine, the roll 15 guiding the web is turned such that it tightens the wire 11 at the edge toward which the web is to move. Then the distance covered by the other edge of the wire is lengthened and wire speed is increased at this edge. This results in a difference in the speed of the wire edges, and the velocity vectors of the wire diverge from the center line of the wire toward the tightened edge, as shown in FIG. 3. The web travelling on the wire seeks to travel toward the tightened edge toward the higher speed, which results in a pumping effect which will transfer the web. When leaving the drying cylinder group, the web travels on in the machine direction.

The web guide roll 15 affects the travel of the wire 11 in a manner corresponding to the effect of the wire guide roll 14 altering the travel direction of the wire. In order to prevent the position of the wire at the drying cylinder group from changing, the effect of the web guide roll 15 on the travel of the wire must be compensated for by means of the wire guide roll 14. By means of these two rolls a speed difference transferring the web is achieved between the edges of the wire and the wire can be made to remain correctly positioned in relation to the center line of the machine.

Web guiding can be carried out manually or automatically by means of a web position measuring device 16 and a web guide roll which can be transferred using an actuator. In the simplest case one of the wire creasing or stretching rolls is used as the web guide roll, which creasing or stretching roll is then slightly turned in relation to the wire within the installation adjustment margin of the roll if a change in the web travel in the machine is desired. Preferably, however, position measurement of the web is used together with a wire guide roll, the position of which can be adjusted by means of an actuator, whereby the web position can be automatically monitored. In automatic monitoring, the position of the wire guide roll is altered on the basis of measurement data from the web position measuring device. In this manner changes in travel direction caused by variable factors affecting the travel of the web can be quickly compensated for. As shown in FIG. 2 the positions of one or more of the wire guide rolls 13, 14, 15 may be adjustable, and a controlled actuator may adjust the positions of any one or more of these wire guide rolls 13, 14, 15 in response to measurements taken by the web position measureing device 16. Manual adjustment of the wire guide rolls 13, 14, 15 is mainly suited for controlling slow changes in the web travel emerging during long-term use.

The method and apparatus of the present invention has been tested on a fast off-machine coater used in normal production operation. The coater was as depicted in FIGS. 1*a*, 1*b* and 1*c*. The machine had four coating heads and an overall length of 400 m. At the beginning of the test, the wire was positioned about 60 mm off the center line at the reel-up end, which is a big enough deviation to render guiding and reeling up difficult. As the web travelled on the skew, the wire stretch roll of the second drying cylinder group had been set in a 3 mm slanting position whereby the wire pulled the web sideways giving rise to the above-mentioned deviation between the web center line and the machine center line over the entire machine length. When the wire guide roll was straightened, the web returned to its centrally travelling position. Normal wire wear was observed, the wire seam remained straight, and no other impediments were observed.

On the basis of the test, the following conclusions can be drawn:

even the smallest change in the position of any roll guiding the wire affects the travel of the wire, thereby significantly influencing the position of the web, guiding has no harmful effect on the wire, and the position of the web in the machine can be effectively controlled using the wire by means of small movements of a roll guiding the wire.

The method and apparatus of the present invention can be applied to all paper manufacturing machinery where the web travels guided by the wire. As the web guide roll, any roll can be used via which the wire travels, except the wire guide roll which is used to reposition the wire which has been diverted by the web guide roll. As the roll movements required are very small, a web guide roll which is controllable by means of an actuator is easy to implement. A turnable roll such as the present wire guide roll is preferably used as the web guide roll, wherefore there is no need to manufacture a special new type of roll for implementing the method. In connection with renewal or maintenance of wires already in operation, a second guidable roll can be installed, whereby the web becomes guidable in the above-described manner.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for guiding travel of a web travelling in a paper or board manufacturing machine, comprising:

supporting the web with a wire during a portion of a path of travel of the web in the machine; and altering a travel position of the wire when in contact with the web such that a velocity vector of the wire, at least at a point of initial contact between the web and the wire, diverges from a center line of travel of the web in the machine, wherein the wire travels around a group of rolls, one of which being a wire guide roll, the travel position of the wire being altered by adjusting a position of the wire guide roll, a position of the web in the machine being detected by a measuring device, the position of the wire guide roll being adjusted by an actuator which adjusts the position of the wire guide roll in accordance with a measurement detected by the measuring device.

2. The method of claim 1, wherein the position of the wire guide roll is adjusted automatically by means of a feedback circuit on the basis of the measurement detected by the measuring device.

3. The method of claim 1, wherein the position of the wire guide roll is adjusted manually.

4. A method for guiding travel of a web travelling in a paper or board manufacturing machine, comprising:

supporting the web with a wire during a portion of a path of travel of the web in the machine; and altering a travel position of the wire when in contact with the web such that a velocity vector of the wire, at least at a point of initial contact between the web and the wire, diverges from a center line of travel of the web in the machine, wherein the wire travels around a group of rolls, one of which being a wire guide roll, the travel position of the wire being altered by adjusting a position of the wire guide roll, one of the rolls in the group of rolls being a web guide roll, the travel position of the wire being further altered by adjusting a position of the web guide roll, a position of the web in the machine being detected by a measuring device, the position of the web guide roll being adjusted by an actuator which adjusts the position of the web guide roll in accordance with a measurement detected by the measuring device.

5. The method of claim 4, wherein the position of the web guide roll is adjusted automatically by means of a feedback circuit on the basis of the measurement detected by the measuring device.

6. The method of claim 4, wherein the position of at least one of the wire guide roll and the web guide roll is adjusted manually.

7. A method for guiding travel of a web travelling in a paper or board manufacturing machine, comprising:

supporting the web with a wire during a portion of a path of travel of the web in the machine; and altering a travel position of the wire when in contact with the web such that a velocity vector of the wire, at least at a point of initial contact between the web and the wire, diverges from a center line of travel of the web in the machine, wherein the wire travels around a group of rolls, one of which being a wire guide roll, the travel position of the wire being altered by adjusting a position of the wire guide roll, one of the rolls in the group of rolls being a wire stretching roll, tension of the wire being altered by adjusting a position of the wire stretching roll, a position of the web in the machine being detected by a measuring device, the position of the wire stretching roll being adjusted by an actuator which adjusts the position of the wire stretching roll in accordance with a measurement detected by the measuring device.

8. The method of claim 7, wherein the position of the wire stretching roll is adjusted automatically by means of a feedback circuit on the basis of the measurement detected by the measuring device.

9. The method of claim 7, wherein the position of at least one of the wire guide roll and the wire stretching roll is adjusted manually.

10. A method for guiding travel of a web travelling in a paper or board manufacturing machine, comprising:

supporting the web with a wire during a portion of a path of travel of the web in the machine; and altering a travel position of the wire when in contact with the web such that a velocity vector of the wire, at least at a point of initial contact between the web and the wire, diverges from a center line of travel of the web in the machine wherein the wire travels around a group of rolls, one of which being a wire guide roll, the travel position of the wire being altered by adjusting a position of the wire guide roll, one of the rolls in the group of rolls being a web guide roll, the travel position of the wire being further altered by adjusting a position of the web guide roll, one of the rolls in the group of rolls being a wire stretching roll, tension of the wire being altered by adjusting a position of the wire stretching roll, a position of the web in the machine being detected by a measuring device, the position of at least one of the wire guide roll, the web guide roll, and wire stretching roll being adjusted by an actuator which adjusts the position of the roll or rolls in accordance with a measurement detected by the measuring device.

11. The method of claim 10, wherein the position of the at least one roll, the position of which is adjustable, is adjusted automatically by means of a feedback circuit on the basis of the measurement detected by the measuring device.

12. The method of claim 10, wherein the position of at least one of the wire guide roll, the web guide roll, and the wire stretching roll is adjusted manually.

* * * * *